US006112516A

United States Patent [19]

Beule et al.

[11] Patent Number: 6,112,516

[45] Date of Patent: Sep. 5, 2000

[54] OPTIMALLY COOLED, CARBURETED FLAMEHOLDER

[75] Inventors: Frédéric Bruno Beule, Paris; Michel André Albert Desaulty, Vert Saint Denis; Eric Charles Louis Le Letty, Saint Michel sur Orge, all of France

[73] Assignee: Societe Nationale d'Etude et de Construction de Moteurs d'Aviation (S.N.E.C.M.A.), France

[21] Appl. No.: 09/177,492

[22] Filed: Oct. 23, 1998

[30] Foreign Application Priority Data

Oct. 23, 1997 [FR] France ..... 97 13274

[51] Int. Cl.[7] ..... F02K 3/10

[52] U.S. Cl. ..... 60/261; 60/749

[58] Field of Search ..... 60/261, 749, 742, 60/738

[56] References Cited

U.S. PATENT DOCUMENTS

| | | | |
|---|---|---|---|
| 4,490,973 | 1/1985 | Kinsey | 60/261 |
| 4,887,425 | 12/1989 | Vdoviak . | |
| 4,901,527 | 2/1990 | Nash et al. | 60/261 |
| 5,396,761 | 3/1995 | Woltmann et al. . | |
| 5,400,589 | 3/1995 | Mahias et al. . | |
| 5,437,159 | 8/1995 | Ansart et al. | 60/749 X |
| 5,813,221 | 9/1998 | Geiser et al. | 60/261 |

FOREIGN PATENT DOCUMENTS

| | | |
|---|---|---|
| 2 696 502 | 4/1994 | France . |
| 2 709 342 | 3/1995 | France . |

*Primary Examiner*—Timothy S. Thorpe
*Assistant Examiner*—David J. Torrente
*Attorney, Agent, or Firm*—Bacon & Thomas PLLC

[57] ABSTRACT

A carbureted flameholder (30) with optial cooling is provided for a bypass turbojet-engine. The flameholder (30) comprises a body (34) which extends radially into the primary flow. The body (34) is formed by a V-dihedral having two outer plates (35, 36) which intersect at a common ridge apex (37). An air tube (38) is mounted between the two outer plates (35, 36) and at least one fuel conduit (44, 45) is disposed to the rear of the air tube (38). The overall cross-section of the air tube (38) is approximately triangular and the air tube (38) includes a transverse downstream wall that is curved to define a trough (42) in which the fuel conduit (44, 45) is located. The air tube (38) includes orifices (41, 46) directed against the dihedral plates (35, 36) and the fuel conduit (44, 45) to cool them. The fuel conduit includes a nozzle injector (46) directed downstream towards the afterburner chamber (23).

4 Claims, 2 Drawing Sheets

OPTIMALLY COOLED, CARBURETED FLAMEHOLDER

BACKGROUND OF THE INVENTION

1. Field of the Invention

The present invention relates to a cooled flameholder for a turbojet-engine. More specifically, the invention relates to a cooled, carbureted flameholder for a turbojet-engine.

2. Description of the Related Art

French patent 2,709,342 discloses an afterburner for a bypass turbojet-engine. The bypass turbojet-engine comprises an outer, substantially annular duct and an exhaust duct contained inside the outer duct. The exhaust duct comprises an annular outer wall and an annular inner wall each having the same longitudinal axis as the outer duct. The exhaust duct and the outer duct define a first flow passage for bypass air. The annular outer wall and the annular inner wall define a second passage therebetween for the combustion gases. The afterburner further comprises an annular afterburner wall which has the same longitudinal axis as the outer duct and is mounted inside the outer duct from which it is spaced by a given distance to define a cooling-air passage. The afterburner wall also defines an afterburner chamber downstream of the first and second passages. The afterburner further comprises flameholders running in radial planes relative to the axis at least inside the second passage. Each flameholder has the shape of a dihedral formed by two outer plates intersecting at a common ridge and has an outer V-section with the tip pointed upstream relative to the overall axial direction of flow of the combustion gases. Each flameholder moreover includes a multi-perforated ventilation tube, to cool the outer plates by cooling air tapped from the first passage, and at least one radial fuel conduit fitted with fuel injection orifices.

The ventilation tube has a circular cross section, is mounted near the ridge of the dihedral, and includes orifices to cool the outer plates of the dihedral. A cross-sectionally semi-circular heat shield is mounted downstream of the fuel conduit between the downstream edges of the dihedral plates and is fitted with lateral, axial slots to allow the air/fuel mixture to flow into the afterburner chamber. The injection orifices of the fuel conduit consist of holes which are in substantially radial planes and point toward the inner walls of the dihedral plates. This flameholder is said to be "carbureted".

French patent 2,696,502 discloses radial flameholders which are also in the shape of dihedrals and include ventilation tubes to cool each dihedral. However, this flameholder is both without a fuel conduit and without a heat shield. In this design, the fuel is injected upstream of the flameholder through fuel conduits mounted laterally on the connecting arms configured in an alternating manner between the flameholders. The injected fuel drains along the outer flameholder walls. The cross-section of the ventilation tube is larger than that of the cylindrical tube of the French patent 2,709,342, thereby assuring improved cooling of the dihedral walls; however, the fuel conduits are exposed to the heat of the combustion gases, risking coking and vapor-lock malfunctions.

SUMMARY OF THE INVENTION

The object of the present invention is to provide an afterburner with flameholders which are carbureted and provide the advantages of the two designs mentioned above.

The goal of the invention is achieved by optimizing the aerodynamic cooling of each flameholder.

To this end, the ventilation tube of the invention has an approximately triangular overall cross-section. The ventilation tube comprises two sides which are substantially parallel to the outer plates and one downstream side wall forming a radial trough which houses a fuel conduit. A plurality of additional orifices directed at the fuel conduit are present in the wall forming the trough to assure ventilation of the fuel conduit injecting fuel in the downstream direction.

Because of this configuration, the flow cross-section of the ventilation tube is larger man the circular cross section of the ventilation tube disclosed in French patent 2,709,342. The flow of cooling air is increased and the outer dihedral plates are impact-cooled by the air passing through orifices located at the sides of the ventilation tube. The trough orifices direct air onto the fuel conduit in all operational modes of the turbojet-engine, thereby precluding coking and vapor-locks and enhancing the heat resistance of the fuel conduit in the "dry" mode of operation, that is when the afterburner chamber is not operating. The locations of the orifices and the shape of the ventilation tube assure optimal ventilation of the dihedral walls and the fuel conduit.

Advantageously, the fuel conduit is fitted with one or more aeromechanical injectors. This design allows good atomization and control of the size of the diffusion cone of the fuel droplets in order to avoid any danger of contact with the outer dihedral plates of the afterburning system.

DETAILED DESCRIPTION OF THE PREFERRED EMBODIMENT

Other features and advantages of the invention are elucidated in the following illustrative description with reference to the attached drawings, in which.

DETAILED DESCRIPTION OF THE PREFERRED EMBODIMENT

Figure 1:
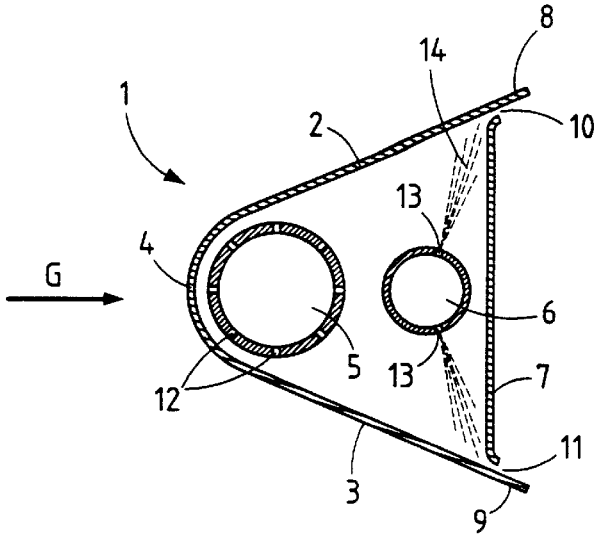
FIG.1 PRIOR ART
FIG. 1 is a sectional view of a known carbureted flameholder.

FIG. 1 is a cross section of a carbureted flameholder, similar to that described in French patent 2,709,342, which is mounted radially in the path of the hot gases flowing from upstream to downstream in the direction of arrow G. The flameholder is formed by sheetmetal bent into a "V" dihedral including two side plates 2, 3 connected by a rounded ridge apex 4 which is directed upstream relative to the overall flow G of the gases. The flameholder includes an air supply tube 5 of circular cross section having multiple perforations or orifices 12 and being mounted between the side plates 2, 3 near the ridge 4. The flameholder also includes a fuel conduit 6 downstream of the air tube 5 and a heat shield 7 which has a convex surface relative to the upstream direction and is connected to downstream edges 8, 9 of the side plates 2 and 3 while forming lateral slots 10, 11 for evacuating the air/fuel mixture. The orifices 12 blow fresh air toward the plates 2, 3 and the ridge 4. The orifices 13 of the fuel conduit 6 inject a fuel flow of 14 toward the lateral slots 10, 11.

Figure 2:
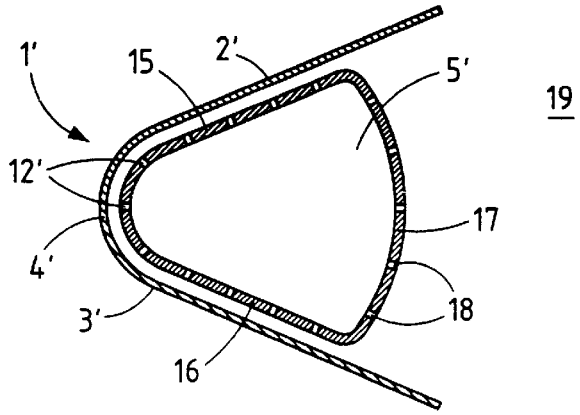
FIG.2 PRIOR ART
FIG. 2 is a sectional view of a known non-carbureted flameholder.

FIG. 2 shows a cross section of a non-carbureted flameholder 1', similar to that described in French patent 2,695,502. The flameholder 1' also is a dihedral with two side plates 2', 3' connected by a rounded ridge apex 4' directed upstream relative to the overall flow G of the hot gases. An air tube 5' is mounted between the side plates 2', 3'. This tube 5' has an approximately triangular cross section with sides 15, 16 that are parallel and close to the side plates 2', 3' and includes orifices 12' blowing fresh air against the side plates 2', 3' The downstream side 17 of the ventilation tube 5' is concave relative to the upstream direction and includes orifices 18 to inject fresh air in the downstream direction into an afterburner chamber 19.

Figure 3:
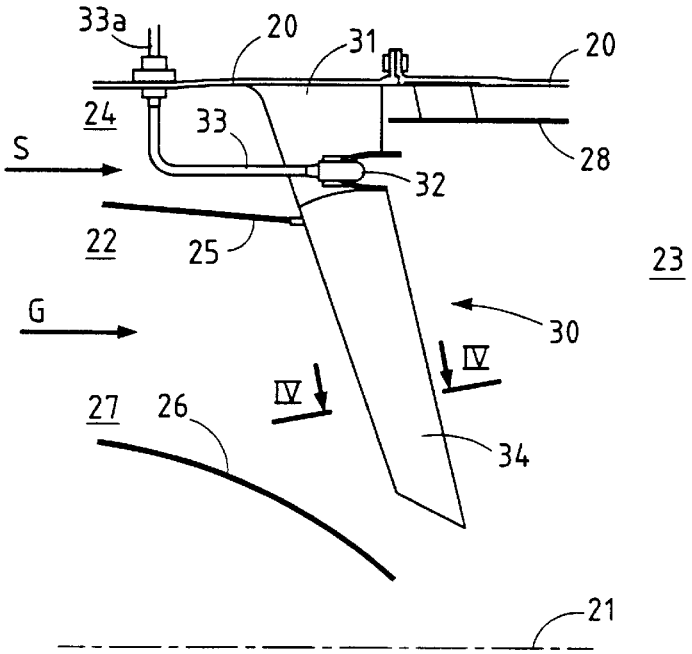
FIG. 3 is an axial half-sectional view of a bypass turbojet-engine including an afterburner according to the invention.

The afterburner and bypass turbojet-engine partially shown in FIG. 3 comprises an annular duct 20 with a longitudinal axis 21, an exhaust duct 22 for the combustion gases from the turbojet-engine's vane assemblies which flow from upstream to downstream in the direction of the arrow G, and an afterburner chamber 23 downstream of the exhaust duct 22.

The exhaust duct 22 comprises an outer annular wall 25 and an inner annular wall 26 each having the same longitudinal axis 21. The exhaust duct 22, the outer wall 25 and the inner wall 26 are connected to each other by linkrods or by radial connecting arms which are omitted from the drawing.

The exhaust duct 22 is contained inside the outer duct 20. The outer wall 25 and the outer duct 20 define a first passage 24 wherein bypass air S flows. The outer wall 25 and the inner wall 26 define a second passage 27 which exhausts the combustion gases.

An annular afterburner wall 28, having the same longitudinal axis 21 and being radially more distant from the axis 21 than the outer wall 25, is mounted near the outer duct 20. The afterburner wall 28 and the inner wall 26 define the afterburner chamber 23.

Flameholders 30 extend radially and obliquely within the combustion chamber 20 and are mounted at the end of the exhaust duct 22 upstream of the afterburner chamber 23. Bach flameholder 30 runs substantially in a radial plane including the axis 21.

Each flameholder 30 comprises a head segment 31 which crosses the first passage 24 and supports an annular burner ring 32 downstream. The burner ring 32 has the same longitudinal axis 21 and is connected by a fuel conduit 33 to a fuel supply 33*a*. Each flameholder 30 further comprises a main body 34 which extends inside the second passage 27 and which is the object of the present invention.

Figure 4:
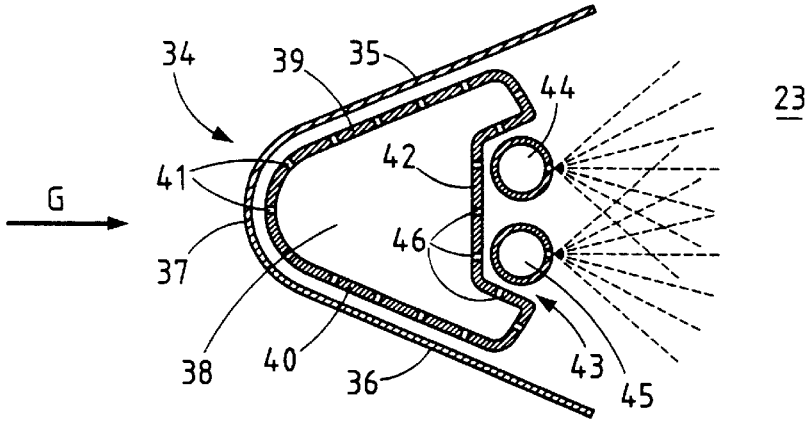
FIG. 4 is a sectional view along line IV—IV of FIG. 3.
Figure 5:
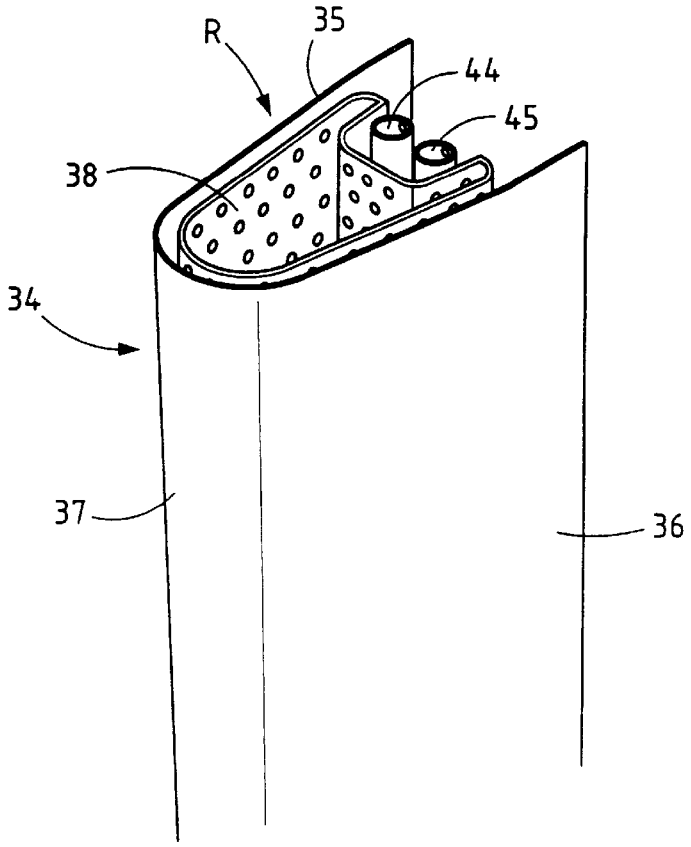
FIG. 5 is a partial perspective view of a flameholder according to the invention.
Figure 6:
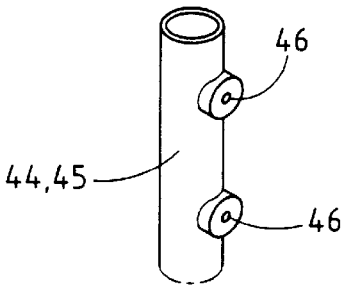
FIG. 6 is a perspective view of the fuel conduit.

As shown in FIGS. 4 through 6, the main body 34 has a dihedral shape with a V-shaped outer cross section with the dihedral ridge apex directed upstream and the legs of the dihedral sides pointed downstream relative to the overall direction of flow G of the hot gases. This main body 34 comprises two outer dihedral plates 35, 36 which intersect at the common, rounded ridge apex 37.

A ventilation tube 38 extends over the full height of the main body 34. This tube 38 is open at its end away from the axis 21, to allow tapping a flow of cooling air R from the first passage 24, and is sealed at its opposite end. Over its full length, the ventilation tube 38 has a plurality of orifices 41 to pass the tapped air.

The ventilation tube 38 has an approximately triangular overall cross section and comprises two side walls 39, 40 which are substantially parallel to and close to the outer plates 35, 36 to effectively cool the outer plates 35, 36 via the orifices 41. A downstream side wall 42 of the ventilation tube is directed toward the inside of the afterburner chamber 23 with a concave shape forming an open U-shaped trough 43. As shown, two radial fuel conduits 44, 45, which are supplied with fuel, are received in the trough 43. Orifices 46 are present in the wall 42 forming the trough 43 through which cooling air is blown toward the fuel conduits 44, 45.

The fuel conduits 44, 45 preferably include aeromechanical injectors 46 which inject fuel downstream toward the afterburner chamber 23. The aeromechanical injectors 46 provide good atomization and allow control of the size of the diffusion cone of fuel droplets to avoid any danger of contacting the V-dihedral of the flameholder 30.

The ventilation tube 38 of the flameholder 30 acts as a structural core and as a supply conduit for the flow of cooling air R. The supply of the flow of cooling air R is implemented in any operational range of the turbojet-engine to prevent coking and vapor lock, both during dry operation and afterburner operation.

The exact shape of the ventilation tube 38 as well as the locations of the orifices 41 and 46 are selected to best achieve thermal resistance.

The configuration proposed by the invention therefore assures the thermal resistance of the dihedral walls and the carburetion system, both in the afterburning mode and in the dry mode. It also allows the elimination of injectors mounted in the primary flow when using non-carbureted flameholders and assures thereby higher operational safety by avoiding the danger of backfiring. The proposed configuration also allows the use of composites in making the dihedral to achieve savings in weight.

The present invention is by no means restricted to the above-described embodiment. On the contrary the present invention is intended to encompass all variations and modifications that fit within the scope and spirit of the claims which follow.

We claim:

1. An afterburner for a bypass turbojet-engine, comprising:

a substantially annular outer duct (20) having a longitudinal axis (21);

an exhaust duct (22) contained within the outer duct (20), the exhaust duct (22) including an outer annular wall (25) and an inner annular wall (26) each having the same longitudinal axis (21) as the outer duct (20);

a first passage (24) for a flow of bypass air which is defined by the outer duct (20) and the outer annular wall (25);

a second passage (27) for a flow of combustion gases which is defined by the outer annular wall (25) and the inner annular wall (26);

an annular afterburner wall (28) mounted inside the outer duct (20) and spaced a given distance therefrom to define a cooling-air passage therebetween, the afterburner wall (28) also having the same longitudinal axis 21 as the outer duct (20);

an afterburner chamber (23) located downstream of the first and second passages (24, 27), the afterburner chamber (23) being defined by the afterburner wall (28);

a plurality of flameholders (30) extending in radial planes relative to the longitudinal axis (21) at least inside the second passage (27), each of the flameholders (30) comprising two outer dihedral plates (35, 36) which intersect at a common ridge apex (37) to form a dihedral shape having a V-shaped outer cross section with the ridge apex directed upstream relative to a generally axial flow direction (G) of the combustion gases;

at least one radial fuel conduit (44, 45) disposed within each of the flameholders (30), the at least one fuel conduit including fuel injection orifices which inject fuel in a downstream direction; and an air tube (38) supplied with pressurized air disposed within each of the flameholders (30), the air tube (38) having multiple orifices (41) directed so as to discharge air against and cool the outer plates (35, 36), the air tube (38) having an approximately triangular overall cross-section and comprising two sides (39, 40) which extend substantially parallel to the outer plates (35, 36) and a downstream transverse curved side wall (42) which forms a radial trough (43) for receiving the at least one fuel conduit (44, 45), the downstream wall (42) having a plurality of additional orifices (46) directed toward the at least one fuel conduit (44, 45) to discharge air against and cool the at least one fuel conduit (44, 45).

2. An afterburner according to claim 1, wherein the at least one fuel conduit (44, 45) is fitted with at least one nozzle injector (46).

3. An afterburner according to claim 1, wherein two radial fuel conduits (44, 45) are disposed within each said radial trough.

4. An afterburner according to claim 3, wherein the two fuel conduits (44, 45) are each fitted with at least one nozzle injector (46).

* * * * *

UNITED STATES PATENT AND TRADEMARK OFFICE

CERTIFICATE OF CORRECTION

PATENT NO. : 6,112,516
DATED : September 5, 2000
INVENTOR(S) : Beule et al.

It is certified that error appears in the above-identified patent and that said Letters Patent is hereby corrected as shown below:

Title page,
Item [57], ABSTRACT
Line 1, "optial" should read -- optimal --.

Column 3,
Line 41, "Bach" should read -- Each --.

Signed and Sealed this

Tenth Day of September, 2002

*Attest:*

*Attesting Officer*

JAMES E. ROGAN
*Director of the United States Patent and Trademark Office*